US005230224A

United States Patent [19]

Ricketts et al.

[11] Patent Number: 5,230,224

[45] Date of Patent: Jul. 27, 1993

[54] REFRIGERANT RECOVERY SYSTEM

[75] Inventors: William H. Ricketts; Francis C. Flusche, both of Muskogee; Charles L. York, Broken Arrow, all of Okla.

[73] Assignee: RSB Engineers/Planners, Inc., Muskogee, Okla.

[21] Appl. No.: 889,680

[22] Filed: May 28, 1992

[51] Int. Cl.[5] ..... F25B 45/00

[52] U.S. Cl. ..... 62/292; 62/77

[58] Field of Search ..... 62/292, 149, 77

[56] References Cited

U.S. PATENT DOCUMENTS

| | | | |
|---|---|---|---|
| 4,285,206 | 8/1981 | Koser | 62/292 |
| 4,441,330 | 4/1984 | Lower et al. | 62/149 |
| 4,766,733 | 8/1988 | Scuderi | 62/77 |
| 4,856,289 | 8/1989 | Lofland | 62/149 |
| 4,903,499 | 2/1990 | Merritt | 62/149 |
| 4,938,031 | 7/1990 | Manz et al. | 62/149 |
| 4,981,020 | 1/1991 | Scuderi | 62/77 |
| 5,094,277 | 3/1992 | Grant | 141/98 |
| 5,127,239 | 7/1992 | Manz et al. | 62/292 |
| 5,152,812 | 10/1992 | Kovach | 55/23 |
| 5,154,737 | 10/1992 | Jenkins et al. | 55/26 |

*Primary Examiner*—Albert J. Makay
*Assistant Examiner*—William C. Doerrler
*Attorney, Agent, or Firm*—Head & Johnson

[57] ABSTRACT

A circuit for recovering refrigerant from a disabled refrigeration unit combines a vacuum pump, vapor pump or compressor in series with a compressor for drawing gaseous refrigerant from the disabled unit. The series arrangement of the vacuum source and the compressor provides approximately −29 inches of mercury at the suction side of the vacuum source. A condensor in series with the compressor converts the gaseous refrigerant into a liquid refrigerant and a storage tank in series with the condenser receives liquid refrigerant from the condenser. In one preferred arrangement a valve system connected in series between the condenser and the storage tank allows the storage tank to be disconnected from the circuit without release of refrigerant from the tank to the atmosphere. The circuit may also include a coil in parallel with the condenser and the compressor and helically disposed around the storage tank for cooling the storage tank. A separator may be connected in series between the vacuum source and the compressor for removing impurities from the gaseous refrigerant and another coil connected in series between the compressor and the condenser and helically disposed around the separator may be used to heat the separator. In addition to the gaseous refrigerant recovery line, a liquid refrigerant line in series between the unit and the storage tank drains liquid refrigerant from the unit into the storage tank prior to operation of the gaseous refrigerant recovery line.

20 Claims, 3 Drawing Sheets 100
200
101
103
105
107
109
111
113
19
201
203
205
207
209
211
213
215
217
219
221
223
225
227
229
231
233
235
237
239
241
243
245
247
249
251
253
255
257
259
261
263
265
267
20
21
22
23
24
30
53
59
61
63
65

REFRIGERANT RECOVERY SYSTEM

BACKGROUND OF THE INVENTION

This invention relates generally to methods and apparatus for servicing refrigeration systems and more particularly concerns the recovering of refrigerants from such systems without release of refrigerant to the atmosphere.

There is presently no known refrigerant recovery system having the capability of removing refrigerant from a refrigeration system without release of refrigerant to the atmosphere which can satisfy Environmental Protection Agency requirements that the suction side of the recovery unit used to draw the refrigerant from the system operate at −29 inches of mercury. The most efficient recovery systems known today operate at −21 inches of mercury and take typically 60 minutes and as much as 2 ½ hours to recover approximately 3 to 7 pounds of refrigerant.

It is, therefore, an object of this invention to provide a refrigerant recovery system which will operate at approximately −29 inches of mercury at the suction side of the recovery unit. It is a further object of this invention to provide a refrigerant recovery system having improved recovery time and volume characteristics. It is also an object of this invention to provide a refrigerant recovery system which does not release refrigerant to the atmosphere. Another object of this invention is to provide a refrigerant recovery system which is economically sensible for use in recovering refrigerant from motor vehicles, window and domestic refrigeration and air conditioning units as well as commercial and industrial refrigeration and air conditioning systems. Other objects of this invention are to provide a refrigerant recovery system which is portable, substantially automatic, of minimum power requirements and of maximum capacity.

SUMMARY OF THE INVENTION

In accordance with the invention, a circuit for recovering refrigerant from a disabled refrigeration unit is provided which combines a vacuum pump, vapor pump or compressor in series with a compressor for drawing gaseous refrigerant from the disabled unit. The series arrangement provides approximately −29 inches of mercury at the suction side of the vacuum pump, vapor pump or compressor. A condensor in series with the compressor converts the gaseous refrigerant into a liquid refrigerant. A storage tank in series with the condenser receives liquid refrigerant from the condenser. In one preferred arrangement a disconnect and valve system connected in series between the condenser and the storage tank allows the storage tank to be disconnected from the circuit without release of refrigerant from the tank to the atmosphere. The circuit may also include a coil in parallel with the condenser and the compressor and helically disposed around the storage tank for cooling the storage tank. Additionally, a separator may be connected in series between the vacuum source and the compressor for removing impurities from the gaseous refrigerant. Another coil connected in series between the compressor and the condenser and helically disposed around the separator may be used to heat the separator. In addition to the gaseous refrigerant recovery line, a liquid refrigerant line in series between the unit and the storage tank drains liquid refrigerant from the unit into the storage tank.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
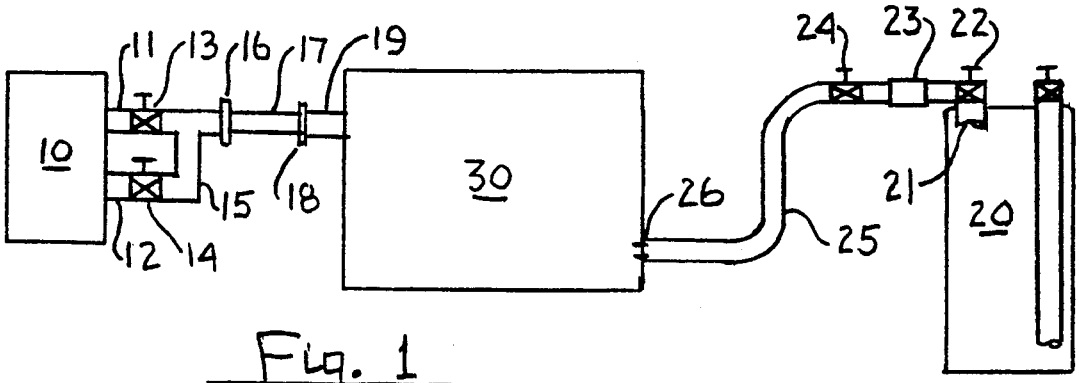
FIG. 1 is a block diagram illustrating the connection of the present recovery unit between a disabled unit and a refrigerant storage tank.

Turning first to FIG. 1, the disabled unit 10 is to have its refrigerant recovered into a storage tank 20 by the recovery unit 30. The disabled unit 10 has a liquid refrigerant outlet 11 and a gaseous refrigerant outlet 12. The outlets 11 and 12 are connected by shut-off valves 13 and 14, respectively, to an outlet line 15 which is in turn connected by a special connector 16, such as a Schraeder type connector, to an environmentally safe hose 17. The hose 17 is in turn connected via a similar connector 18 to the inlet line 19 to the recovery unit 30.

The storage tank 20 is connected to the recovery unit 30 through a high level inlet 21, a shut-off valve 22, a disconnect line 23, another shut-off valve 24 and line 25, which is connected to the outlet 26 of the recovery unit 30. In the field, the inlet line 19 to the recovery unit 30 is connected to the disabled unit as shown and the storage tank is connected to the outlet line 26 of the recovery unit 30 as shown. Once the contents of the disabled unit 10 have been evacuated into the storage tank 20, the valves 22 and 24 can be closed and the tank 20 removed from the system at the disconnect line 23. The length of the disconnect line 23 is such that removal of the tank 20 permits only allowable units of refrigerant to be released externally of the storage tank 20. The storage tank 20 as shown includes high level and low level inlet lines because this is the structure of most tanks presently available. The present invention, however, uses only the high level line 21.

Figure 2:
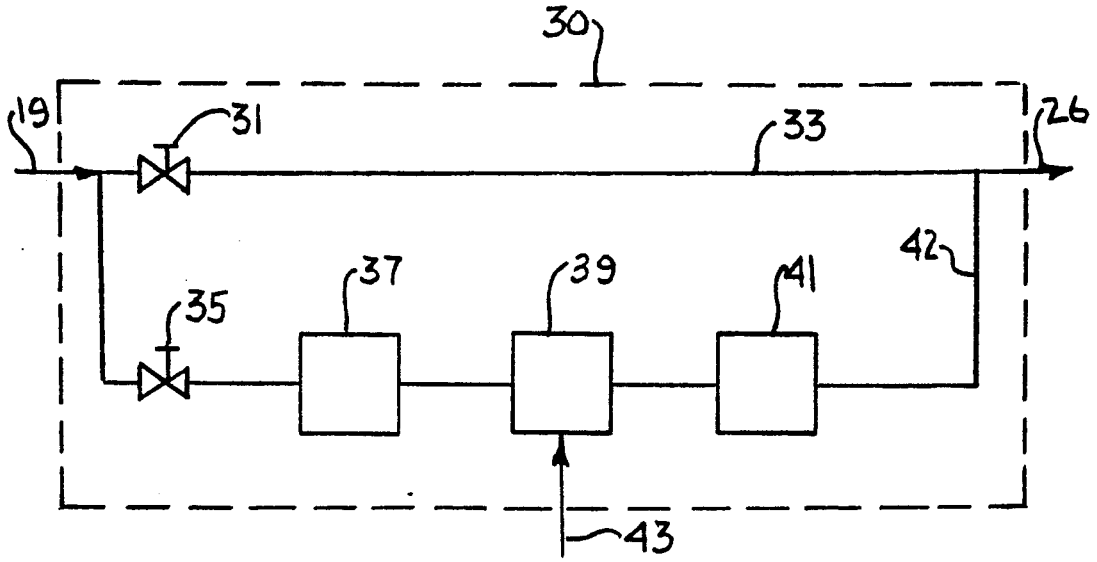
FIG. 2 is a block diagram of one embodiment of the recovery unit.

Turning now to FIG. 2, one embodiment of a recovery unit 30 to be connected between the input line 19 and the output line 26 is illustrated. The inlet line 19 connects through a shut-off valve 31 to a liquid refrigerant flow line 33 which extends to the outlet line 26. Thus, with the valve 31 in the open condition, liquid refrigerant flows directly from the disabled unit 10 through the recovery unit 30 to the storage tank 20. The inlet line 19 also T's to a second shut-off valve 35 which connects the inlet line 19 in series with a vacuum pump 37, a compressor 39 and a condenser 41 and which then T's back to the line 33 connected to the inlet line 26. Thus, when liquid refrigerant has been drained from the disabled unit 10, the liquid refrigerant valve 31 may be closed and the gaseous refrigerant valve 35 opened so that the vacuum pump 37 and the compressor 39 can cooperate to evacuate the gaseous refrigerant from the disabled unit 10 into the storage tank 20. This system may also include a second input 43 to the compressor 39 for reasons to be hereinafter explained.

Figure 3:
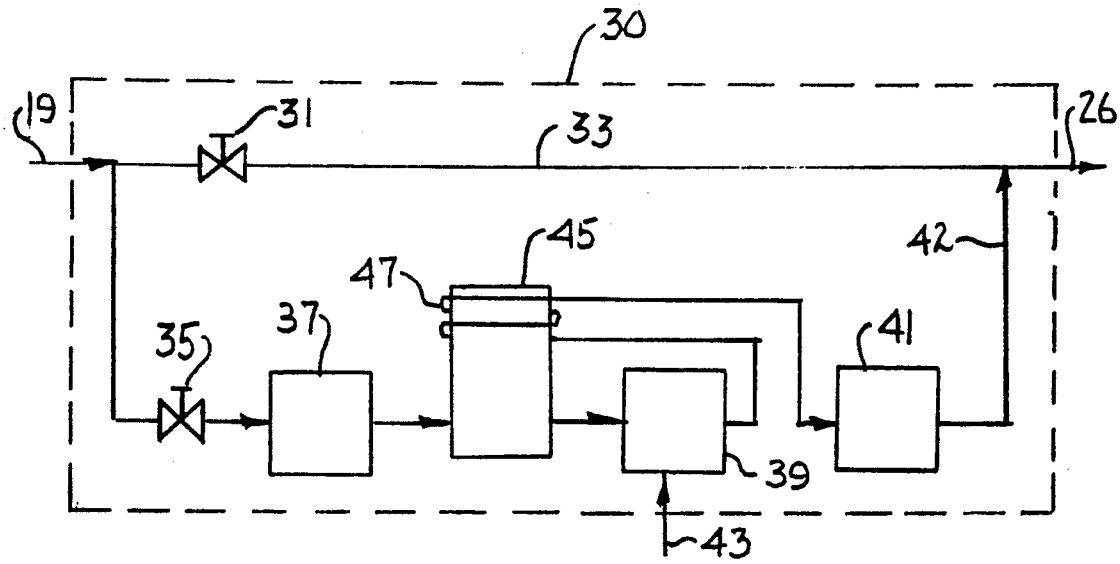
FIG. 3 is a block diagram of another embodiment of the recovery unit.

Turning to FIG. 3, the recovery unit illustrated in FIG. 2 may further include a separator 45 connected in series between the vacuum pump 37 and the compressor 39. When a separator 45 is used in the recovery unit 30, it may be desirable to connect a heating coil 47 in series between the compressor 39 and the condenser 41 so as to use the gaseous refrigerant recovered from the disabled unit 10 to heat the separator 45 and thus evaporate impurities introduced into the separator 45.

In some applications, it may also be desirable to cool the contents of the storage tank 20 to assure that the liquid refrigerant contained in the tank 20 does not boil and increase the pressure within the tank 20. This may be accomplished by inclusion in the recovery unit 30 of the cooling circuit 50 illustrated in FIG. 4. In the circuit 50, a two-way valve 51 is connected in series with the output line 42 of the condenser 41 shown in FIGS. 2 or 3 so that condensed refrigerant can be caused to flow both directly to the input 21 of the storage tank 20 and to a cooling coil 53 helically wound around the storage tank 20. The coil 5 is connected in series between the two-way valve 51 and a cooling outlet line 43 which extends back to the compressor 39 as shown in FIGS. 2 or 3. In addition, the series connection between the two-way valve 51 and the input to the cooling coil 53 can be accomplished by the parallel arrangement of two or more flow lines 55 and 57 having respective shut-off valves 59 and 61 so as to accommodate different types of refrigerant. These lines may further include metering devices or expansion valves 63 and 65 as may be required in any specific application. Finally, the outlet line of the valve 51 which extends through the recovery unit outlet line 26 to the storage tank input 21 may include a check valve 67, such as a magnetic check valve, to prevent the possibility of liquid refrigerant in the storage tank 20 returning into the system.

Figure 5:
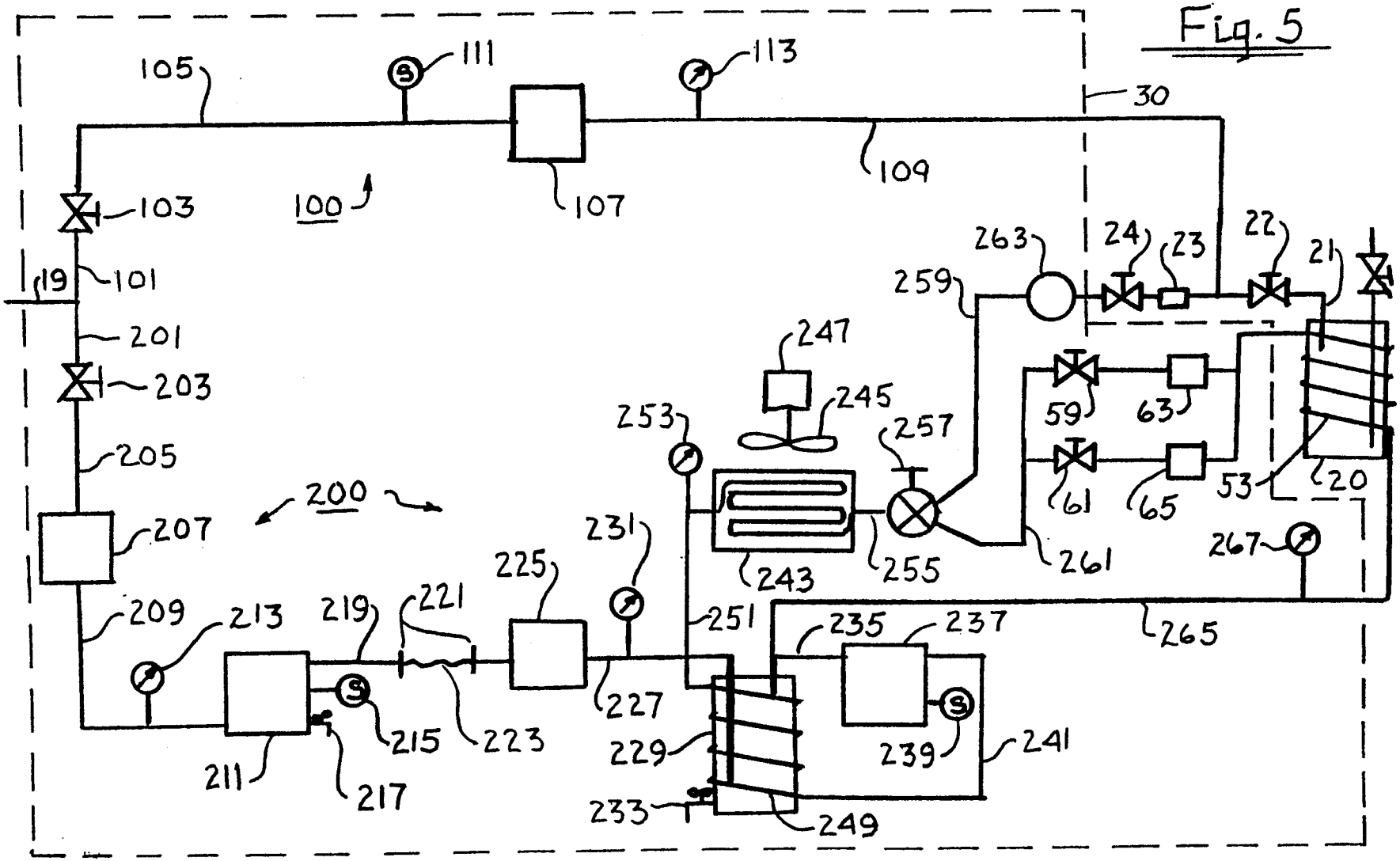
FIG. 5 is a schematic diagram illustrating an embodiment of the recovery unit connected between the disabled unit and the storage tank.

Turning now to FIG. 5, one particularly preferred embodiment of the recovery unit 30 is illustrated for use in recovering refrigerant from any of a variety of disabled units 10 such as a motor vehicle, a window air conditioner, or other domestic, commercial or industrial refrigeration or air conditioning systems. The retrieval circuit of the recovery unit includes two discrete paths 100 and 200, the first path 100 for draining refrigerant in the liquid state from the disabled unit 10 and the second path 200 for removal of refrigerant in a gaseous state from the disabled unit 10.

The first discrete path 100 consists of a line 101 connecting the inlet 19 of the recovery unit 30 through a shut-off valve 103 and another line 105 to a filter dryer 107. From the filter dryer 107, another line 109 extends to the input valve 22 to the storage tank 20. A sight glass 111 may be provided along the first discrete path 100 so that the status of liquid refrigerant flow can be visually determined. A pressure gauge 113 may also be used in 15 the liquid refrigerant line 100 to enable confirmation of proper operation of the system. The system may, however, be operated with or without the filter dryer 107 which is used to remove acid and water vapor from the liquid refrigerant before it passes to the tank 20.

The second discrete path 200 includes a line 201 extending from the inlet 19 of the recovery unit 30 through a shut-off valve 203 and another line 205 to a pressure regulator 207. From the pressure regulator 207, another line 209 extends to a vacuum source 211. The vacuum source 211 might typically be a vapor pump, a vacuum pump or a compressor providing suction at the inlet 19 of the recovery unit 30. A pressure gauge 213 at the inlet or suction side of the vacuum source 211 is used to indicate the pressure at that point. The vacuum source 211 may also include a sight glass 215 and an oil drain 217.

The output side of the vacuum source 211 is connected via a line 219 through a special connector 221, such as a Schraeder type connector, to a section of environmentally safe hose 223, which may then be connected through a similar connector 221 to a filter dryer 225. The output of the filter dryer 225 may be connected by a line 227 to the input of a separator 229 and the pressure at this point determined by use of a pressure gauge 231 connected in the line 227. The separator 229 as shown has a drain 233 for removal of oil from the separator 229. The output of the separator 233 is connected by a line 235 to a compressor 237. The use of the filter dryer 225 and separator 229 is optional. In any event, a check valve may be used in the line connecting the vacuum source 211 and the compressor 237 to prevent reverse flow between them.

The connection of the compressor 237 in series with the vacuum source 211 enables the system to provide the desired −29 inches of mercury at the suction side of the vacuum source 211, as will be indicated at the gauge 213. The filter dryer 225 and the separator 229 are not necessary for this purpose.

Figure 4:
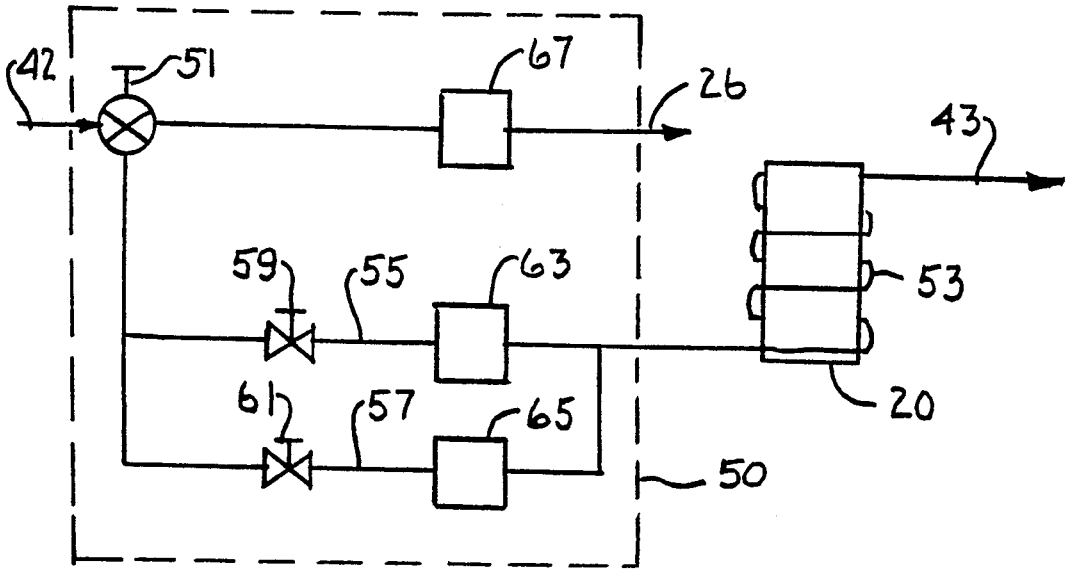
FIG. 4 is a block diagram illustrating the connection of a coil circuit in the recovery unit for cooling the storage tank.

Fluid levels in the compressor 237 may be determined via a sight glass 239. The output of the compressor 237 is fed via another line 241 to the condenser 243 including a fan 245 and motor 247. As shown, if a separator 229 is used, it may be desirable to connect a heating coil 249 through another line 251 so that the coil 249 is connected in series between the compressor 237 and the condenser 243. Otherwise, the compressor 237 can be connected directly to the condenser 243 as shown in FIG. 2. The pressure at the input to the condenser 243 may be determined by a pressure gauge 253. The output of the condenser 243 is fed via a line 255 through a two-way valve 257 which allows the liquid refrigerant output from the condenser 243 to be fed via one line 259 toward a tank input 21 or via another line 261 toward a cooling coil 53 of the tank 20 if cooling is desired. The tank input line 259 extends through a check valve 263 to the on/off valve 24 and the connector 23 as shown in FIG. 1. The cooling coil line 261 may be divided into parallel branches including the valves 59 and 61 and metering devices or expansion valves 63 and 65, as shown in FIG. 4. When the cooling coil 53 is used in association with the tank 20, the cooling line 261 is connected through this parallel arrangement to one side of the cooling coil 53 and the other side of the coil 53 is connected via a line 265 to the input to the compressor 237. The pressure at the output side of the cooling coil 53 is measured by use of a pressure gauge 267 connected to the cooling coil output line 265.

The unit 30 may be used without the tank cooling circuit 50 in the field. After recovery from the disabled unit 10, the tank 20 can be disconnected from the system and reconnected to a separate cooling system elsewhere. A new tank 20 can then be connected to the unit 30 for further field work.

As hereinbefore stated, the use of the filter dryer 225, the separator tube 29, the heating coil 249 and the cooling coil 53 are optional elements of the recovery unit depending on a given application. The essential elements of the unit include the vacuum pump 211, which may for example be a J/B Industries Model DV-42, the compressor 237, which may for example be a Mitchushita Model ACH25X1U and the condenser 243 which may for example be an 8×14 Heatcraft 1 row staggered condensing coil.

Thus, it is apparent that there has been provided, in accordance with the invention, a refrigerant recovery system that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A circuit for recovering refrigerant from a disabled refrigeration unit comprising vacuum means for drawing gaseous refrigerant from the unit, compressing means in series with said vacuum means for drawing said gaseous refrigerant from said vacuum means and condensing means in series with said compressing means for converting said gaseous refrigerant into a liquid refrigerant.

2. A circuit according to claim 1 further comprising storage means in series with said condensing means for receiving liquid refrigerant from said condensing means.

3. A circuit according to claim 2 further comprising disconnect means and valve means in series between said condensing means and said storage means whereby said storage means may be disconnected from said circuit without release of refrigerant contained therein.

4. A circuit according to claim 2 further comprising a coil means in parallel with said condensing means and said compressing means and helically disposed around said storage means for cooling said storage means.

5. A circuit according to claim 2 further comprising separating means in series between said vacuum means and said compressing means for removing impurities from said gaseous refrigerant.

6. A circuit according to claim 5 further comprising coil means in series between said compressing means and said condensing means and helically disposed around said separating means for heating said separating means.

7. A circuit according to claim 2 further comprising liquid refrigerant recovery means in series between the unit and said storage means for draining liquid refrigerant from the unit into said storage means.

8. A circuit according to claim 7 further comprising valve means for selectively connecting said gaseous refrigerant vacuum means and said liquid refrigerant recovery means to the unit.

9. For use in recovering refrigerant from a disabled refrigeration unit, a circuit comprising:

a first discrete path for draining liquid refrigerant from the unit; and a second discrete path for removing gaseous refrigerant from the unit, said second path having a vacuum means for drawing said gaseous refrigerant from the unit, a compressing means in series with said vacuum means for drawing said gaseous refrigerant from said vacuum means and condensing means in series with said compressing means for converting said gaseous refrigerant into a liquid refrigerant.

10. A circuit according to claim 9 further comprising storage means in series with said condensing means for receiving liquid refrigerant from said condensing means and disconnect means and valve means in series between said condensing means and said storage means whereby said storage means may be disconnected from said retrieval circuit without release of refrigerant contained therein.

11. A circuit according to claim 10 further comprising coil means in parallel with said condensing means and said compressing means and helically disposed around said storage means for cooling said storage means.

12. A circuit according to claim 10 further comprising separating means in series between said vacuum means and said compressing means for removing impurities from said gaseous refrigerant and coil means in series between said compressing means and said condensing means and helically disposed around said separating means for heating said separating means.

13. A circuit according to claim 10 further comprising valve means for selectively connecting said first and second paths to the unit.

14. A method of recovering gaseous refrigerant from a disabled refrigeration unit comprising the steps of:

connecting a recovery circuit having pumping and compressing means connected in series to the unit;

pumping gaseous refrigerant from the unit;

compressing said pumped refrigerant in a continuous flow path;

condensing said compressed refrigerant into a liquid refrigerant.

15. A method according to claim 14 further comprising the step of storing said condensed liquid refrigerant in a receiving tank.

16. A method according to claim 15 further comprising the step of cooling said receiving tank by circulating a portion of said condensed liquid refrigerant through a coil surrounding said receiving tank.

17. A method according to claim 15 further comprising the step of filtering said pumped gaseous refrigerant through a separator to remove impurities before compressing said pumped refrigerant.

18. A method according to claim 17 further comprising the step of heating said separator by circulating said compressed refrigerant through a coil surrounding said separator before condensing said compressed refrigerant.

19. A method according to claim 15 further comprising the steps of:

isolating said receiving tank from said circuit; and disconnecting said receiving tank from said circuit without release of refrigerant contained therein.

20. A method according to claim 15 further comprising the step of draining liquid refrigerant from the unit into said receiving tank before pumping said gaseous refrigerant.

* * * * *